US006385795B1

(12) United States Patent
Ferber et al.

(10) Patent No.: US 6,385,795 B1
(45) Date of Patent: May 14, 2002

(54) BATH APPARATUS

(75) Inventors: Roman S. Ferber, West Bloomfield, MI (US); Alex Wong Chi To, Hong Kong (HK)

(73) Assignee: HoMedics, Inc., Commerce Township, MI (US)

( * ) Notice: Subject to any disclaimer, the term of this patent is extended or adjusted under 35 U.S.C. 154(b) by 0 days.

(21) Appl. No.: 09/631,643

(22) Filed: Aug. 2, 2000

(51) Int. Cl.[7] ..... A47K 3/022
(52) U.S. Cl. ..... 4/622; 601/158; 607/86
(58) Field of Search ..... 4/541.1, 541.5, 4/621, 622; 601/22, 154, 158, 166; 607/86, 111

(56) References Cited

U.S. PATENT DOCUMENTS

| | | | | | |
|---|---|---|---|---|---|
| 5,029 | A | | 3/1847 | Thatcher | |
| 2,633,846 | A | | 4/1953 | Wray | |
| 2,736,038 | A | | 2/1956 | Mansfield | |
| 2,904,037 | A | | 9/1959 | Cassidy | |
| 3,055,357 | A | | 9/1962 | Redka | |
| 3,380,080 | A | | 4/1968 | Farrell | |
| 3,965,495 | A | * | 6/1976 | McNair | 4/622 |
| 4,057,053 | A | * | 11/1977 | Kunz | 601/158 X |
| 4,497,313 | A | | 2/1985 | Kurosawa | |
| 4,513,735 | A | | 4/1985 | Friedson et al. | |
| 4,880,415 | A | | 11/1989 | Urakami | |
| 5,588,161 | A | | 12/1996 | Barradas | |
| 5,729,841 | A | * | 3/1998 | Chan | 4/622 |

FOREIGN PATENT DOCUMENTS

| | | | | |
|---|---|---|---|---|
| DE | 1429756 | * | 2/1969 | 4/622 |
| DE | 2945866 | * | 5/1981 | 4/622 |
| EP | 64178 | * | 11/1982 | 4/622 |

* cited by examiner

*Primary Examiner*—Robert M. Fetsuga
(74) *Attorney, Agent, or Firm*—Brooks & Kushman P.C.

(57) ABSTRACT

An apparatus is provided for bathing body parts, such as the feet. The apparatus includes a bath chamber for containing fluid, such as water, and receiving the body part therein. The bath chamber includes a bottom surface and a wall structure extending upwardly therefrom, wherein the wall structure has a contact area adapted to be exposed when fluid is contained in the bath chamber. A heating member is provided on the contact area for providing heat, such as infrared rays, to the body part when the body part is placed on the contact area. In addition, the bath apparatus can include at least one massage attachment adapted to be received on the contact area for massaging the body part when the body part engages the massage attachment.

23 Claims, 9 Drawing Sheets

BATH APPARATUS

TECHNICAL FIELD

This invention relates to an apparatus for bathing body parts, such as the feet or hands.

BACKGROUND ART

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of foot baths have been utilized as therapeutic devices for the feet. Typically, foot baths provide heated water for which the temperature is maintained via electrical means. In addition, current foot baths often provide massage to the feet through vibration of the foot bath. Vibratory massage enhances the therapeutic results achieved with soaking alone by further increasing circulation, as well as relaxing and massaging the muscles.

While heat and vibration applied to the feet in an overall manner is helpful, conventional foot baths are not designed with the capability to target specific areas of the feet. For example, it is common for a user to wish to concentrate treatment to a specific part or parts of his/her feet such as the ball, heel, or arch. Therefore, a need exists for a bath apparatus with the capability to focus heat and/or massage at specific locations of the body. Such a bath apparatus would not only allow users to tailor therapy regimens to their individual needs, but would also increase the speed at which therapy can be accomplished, thereby increasing the convenience for the user.

DISCLOSURE OF INVENTION

Therefore, it is a principal object according to the present invention to provide an apparatus for bathing body parts and providing targeted therapy, including heat and massage, to the body parts.

Accordingly, an apparatus is provided for bathing body parts, such as the feet or hands. The bath apparatus includes a bath chamber for containing fluid, such as water, and receiving the body part therein. The bath chamber includes a bottom surface and a wall structure extending upwardly therefrom, wherein the wall structure has a contact area adapted to be uncovered by fluid contained in the bath chamber. A heating member is provided on the contact area for providing heat to the body part when the body part is placed on the contact area.

According to one embodiment of the present invention, the heating member uses infrared rays. In addition, a heater is provided in communication with the bath chamber for maintaining the heat of the fluid contained therein. Preferably, the heater includes a rope heating element provided underneath the bottom surface of the bath chamber. Furthermore, the bath apparatus includes a pump in communication with the bath chamber for directing air into the bath chamber to generate air bubbles in the fluid contained within the bath chamber, wherein air flows through a plurality of holes provided in the bottom surface of the bath chamber. Still further, the bath apparatus includes a vibration assembly in communication with the bath chamber for imparting vibration to the bath chamber. The vibration assembly includes a motor affixed to an underside of the bath chamber, an output shaft rotatably driven by the motor, and a counterweight affixed to the output shaft.

In further accordance with the present invention, the bath apparatus includes at least one massage attachment adapted to be received on the contact area for massaging the body part when the body part engages the massage attachment. The massage attachment can be stationary, or can be manually rotatable by a user. Alternatively, rotation of the massage attachment can be motorized. In this embodiment, a motor is disposed on the underside of the bath chamber, and the massage attachment is adapted to be received on an output shaft that is rotatably driven by the motor and adapted to be accessible through the contact area. Optionally, the motorized rotation of the massage attachment can be activated by applied pressure of the body part on the massage attachment.

Preferably, a plurality of different massage attachments are provided. The massage attachments can include, for example, attachments with raised nodes, a roller, a pumice stone, and a brush. A storage unit is provided which is adapted to be attached to the wall structure for storing the one or more massage attachments therein.

According to the present invention, an outer housing is provided to encase the bath chamber. Preferably, the bath chamber is generally U-shaped and the contact area is generally peninsular, such that the contact area is centrally disposed within the bath chamber. The bath chamber preferably includes a plurality of raised nodes provided on its bottom surface. Additionally, the bottom surface of the bath chamber can include rollers provided thereon, wherein the rollers can be detachable from the bottom surface. The bath apparatus can also include a lid adapted to be attached to the wall structure to at least partially cover the bath chamber.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
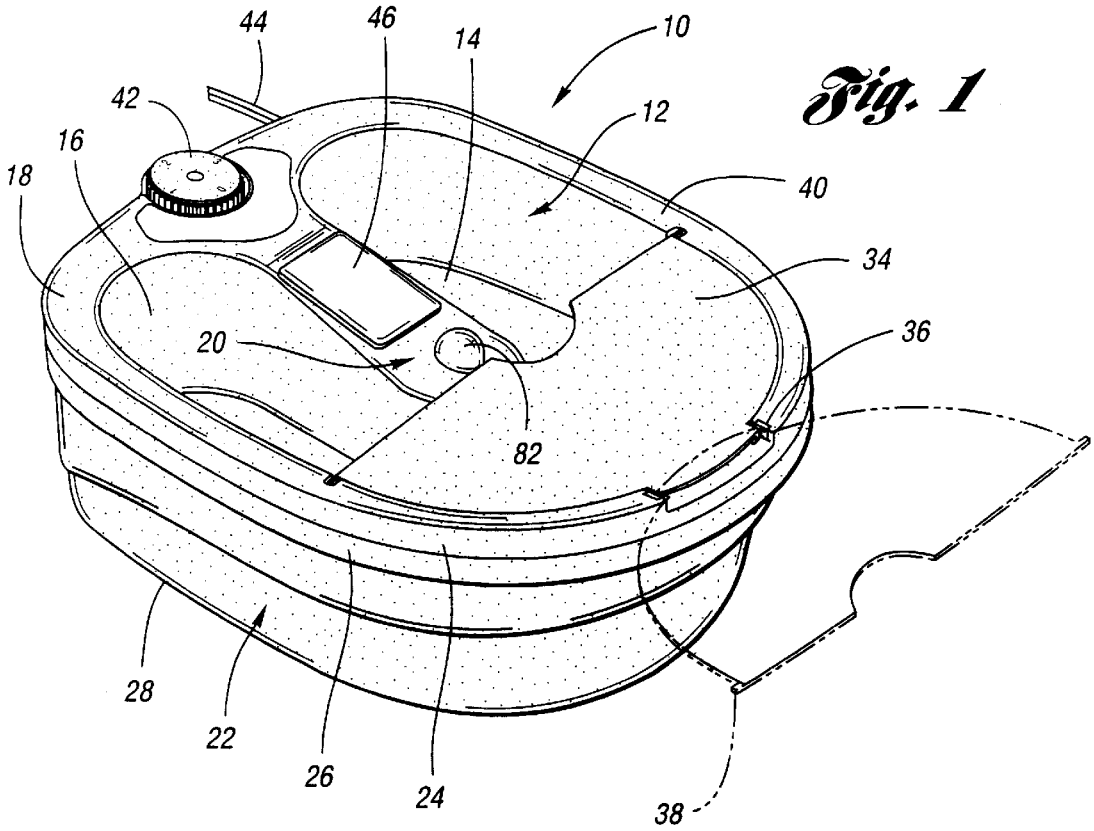
FIG. 1 is a perspective view of a bath apparatus constructed in accordance with the present invention.

Referring first to FIGS. 1–8, a bath apparatus constructed according to the present invention is depicted and designated generally by reference numeral 10. Bath apparatus 10 can be used to provide heat, massage, bubbles, and combinations thereof to body parts, such as the feet. Bath apparatus 10 is preferably constructed from a plastic material so as to be lightweight and portable, as well as durable, leakproof, and corrosion resistant. Although bath apparatus 10 is illustrated and described herein as being particularly adaptable for use as a foot bath, it is understood that bath apparatus 10 of the present invention may be used for bathing other body parts, such as the hands.

With reference to FIG. 1, bath apparatus 10 includes a bath chamber 12 for containing fluid, such as water, and receiving the body part, such as the foot, therein. Bath chamber 12 includes a bottom surface 14 and a wall structure 16 extending upwardly therefrom. Wall structure 16 terminates in an upper surface 18 that includes a contact portion 20 adapted to be exposed when water is contained in bath chamber 12. Bottom surface 14 can be generally parallel to a supporting surface on which bath apparatus 10 is placed or, alternatively, bottom surface 14 could be slanted downwardly toward the user.

Figure 2:
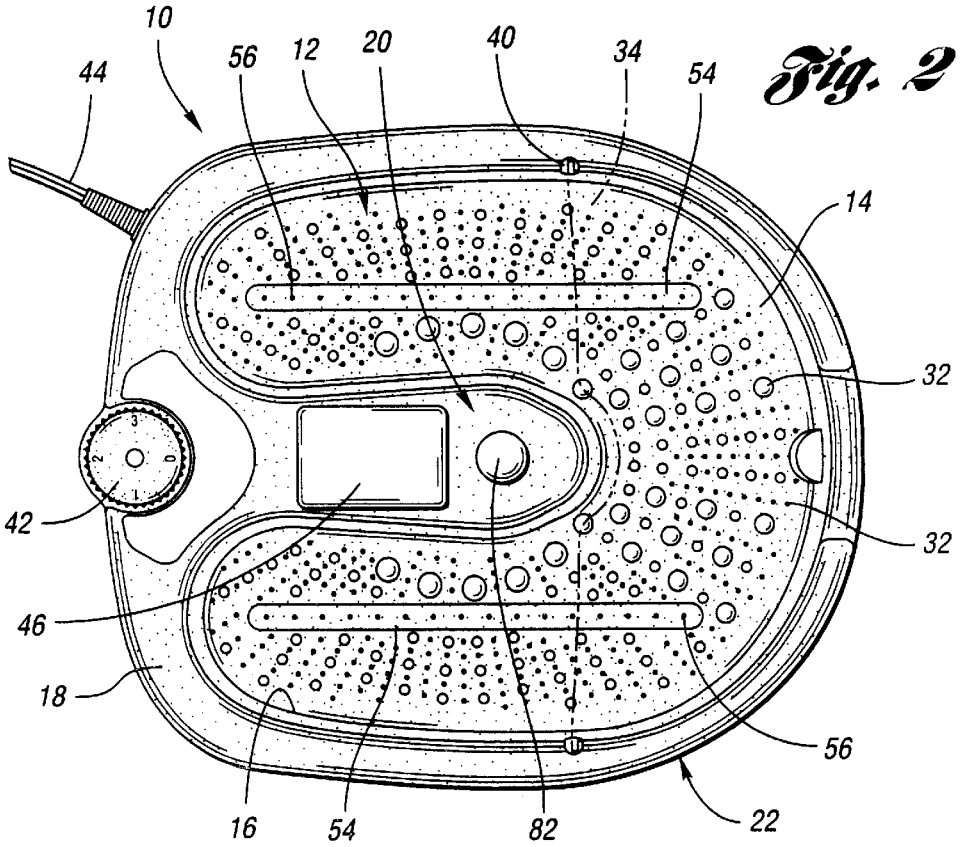
FIG. 2 is a top plan view of the bath apparatus of FIG. 1.

Bath chamber 12 is of a length and width to accommodate the feet of an adult user, such that sufficient space is provided to permit the user to readily insert and remove his/her foot and to allow the foot to be moved about slightly while in position within bath chamber 12. As shown in FIGS. 1 and 2, bath chamber 12 is generally U-shaped and contact portion 20 is generally peninsular and centrally disposed within bath chamber 12. With this configuration, a user's feet are received on either side of peninsular contact portion 20, wherein the feet are spaced apart sufficiently to provide comfortable placement. For use, bath chamber 12 is filled with water such that a user, preferably seated, submerses his/her feet up to approximately the height of the ankles. A user can then easily remove his/her foot for placement on contact portion 20 for targeted therapy as described below. Of course, it is understood that contact portion 20 can have any location on bath apparatus 10 which remains uncovered by water and is accessible to the user.

Figure 3:
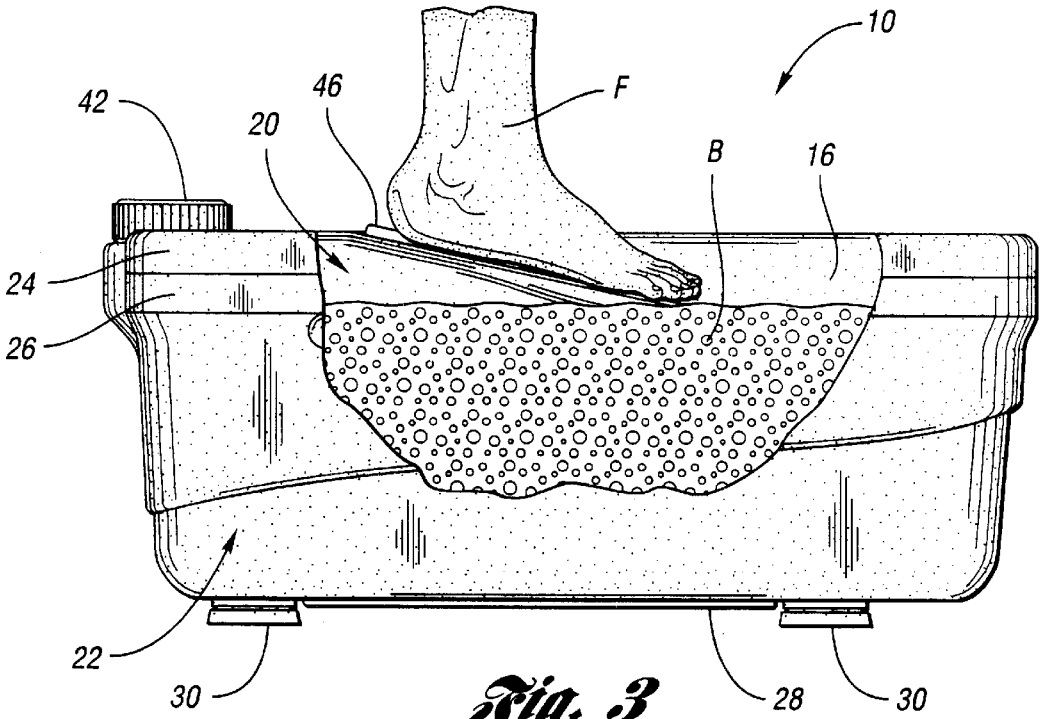
FIG. 3 is a side elevational view of the bath apparatus of FIG. 1, wherein the wall structure is partially cut away to show a user's foot engaging the contact portion.
Figure 4:
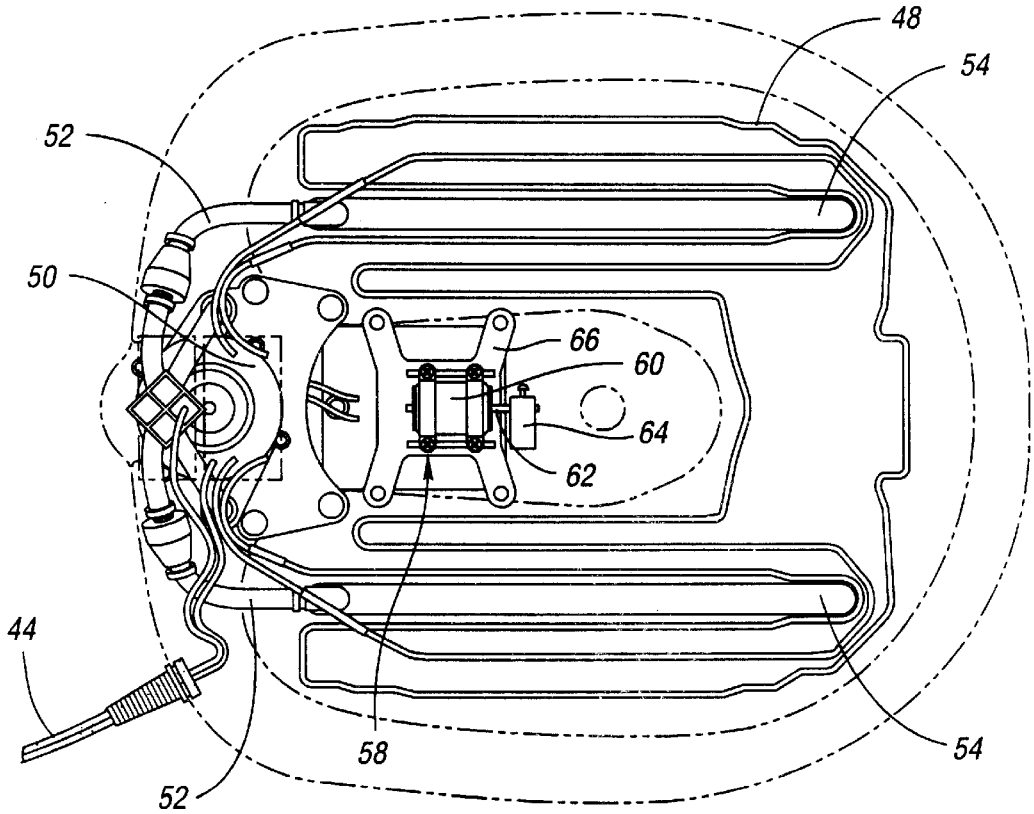
FIG. 4 is a fragmentary view of the pump, heating, and vibration assemblies located on the underside of the bath chamber.
Figure 5:
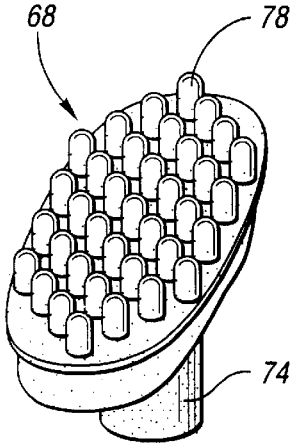
FIG. 5 is a perspective view of a first stationary massage attachment adapted to be received on the contact portion.
Figure 6:
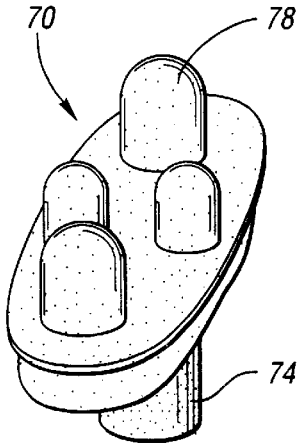
FIG. 6 is a perspective view of a second stationary massage attachment.
Figure 7:
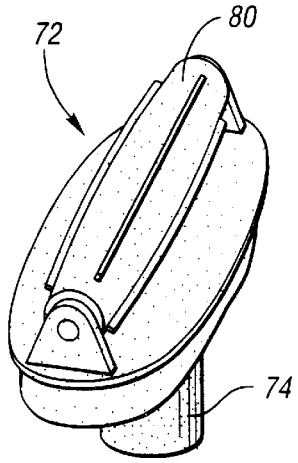
FIG. 7 is a perspective view of a roller massage attachment.
Figure 8A:
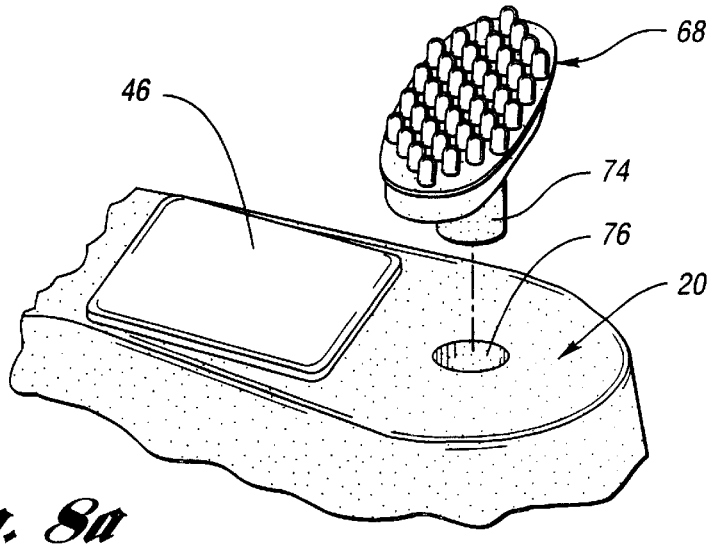
FIGS. 8*a* and 8*b* are fragmentary perspective views of the first stationary massage attachment before and after attachment to the contact portion, respectively.
Figure 8B:
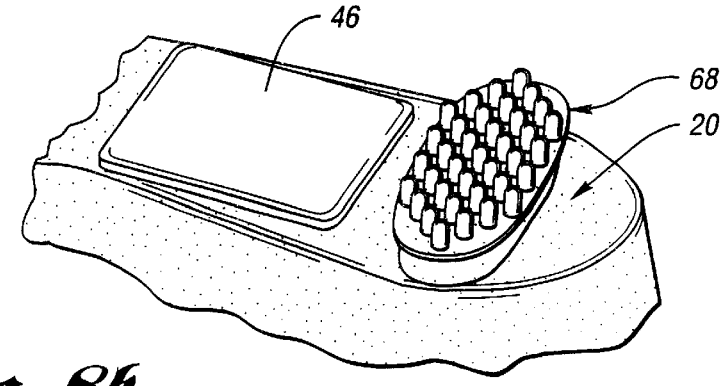

An outer housing 22 is provided to encase bath chamber 12, wherein outer housing 22 is spaced from bath chamber 12 to provide a location for housing the various mechanical/electrical assemblies of bath apparatus 10, as described below with reference to FIG. 4. As best shown in FIGS. 1 and 3, upper surface 18 of bath chamber 12 includes a downwardly extending flange 24 which aligns with an upwardly extending flange 26 of outer housing 22. Flanges 24, 26 are secured together by screws (not shown) to fix bath chamber 12 in position with respect to outer housing 22. The base 28 of outer housing 22 is preferably provided with feet 30 constructed from a material such as rubber to prevent movement of bath apparatus 10 along a supporting surface.

Figure 9:
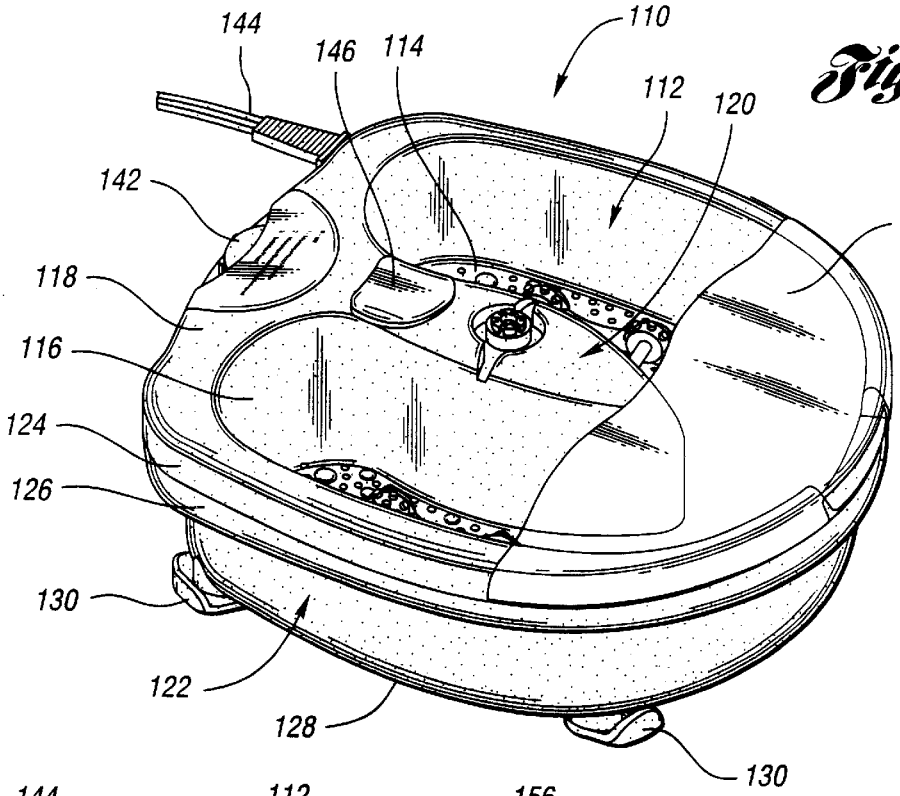
FIG. 9 is a perspective view of a second embodiment of the bath apparatus according to the present invention.
Figure 10:
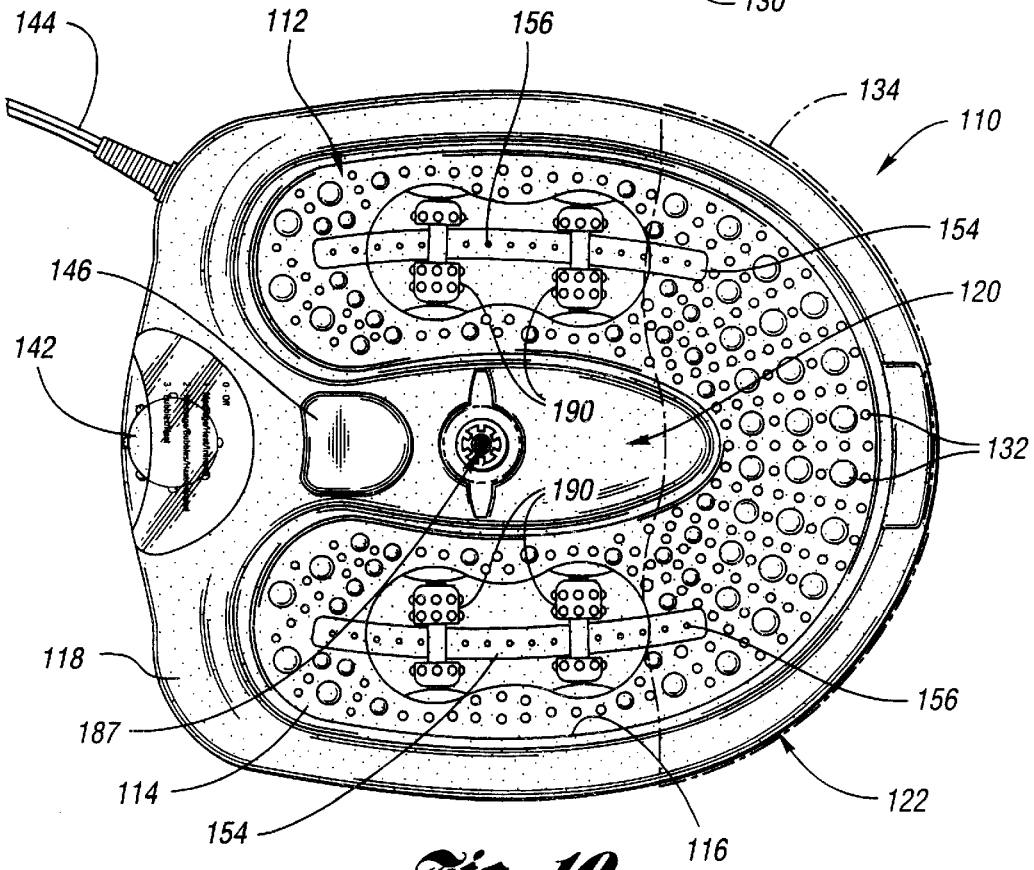
FIG. 10 is a top plan view of the bath apparatus of FIG. 9.
Figure 11:
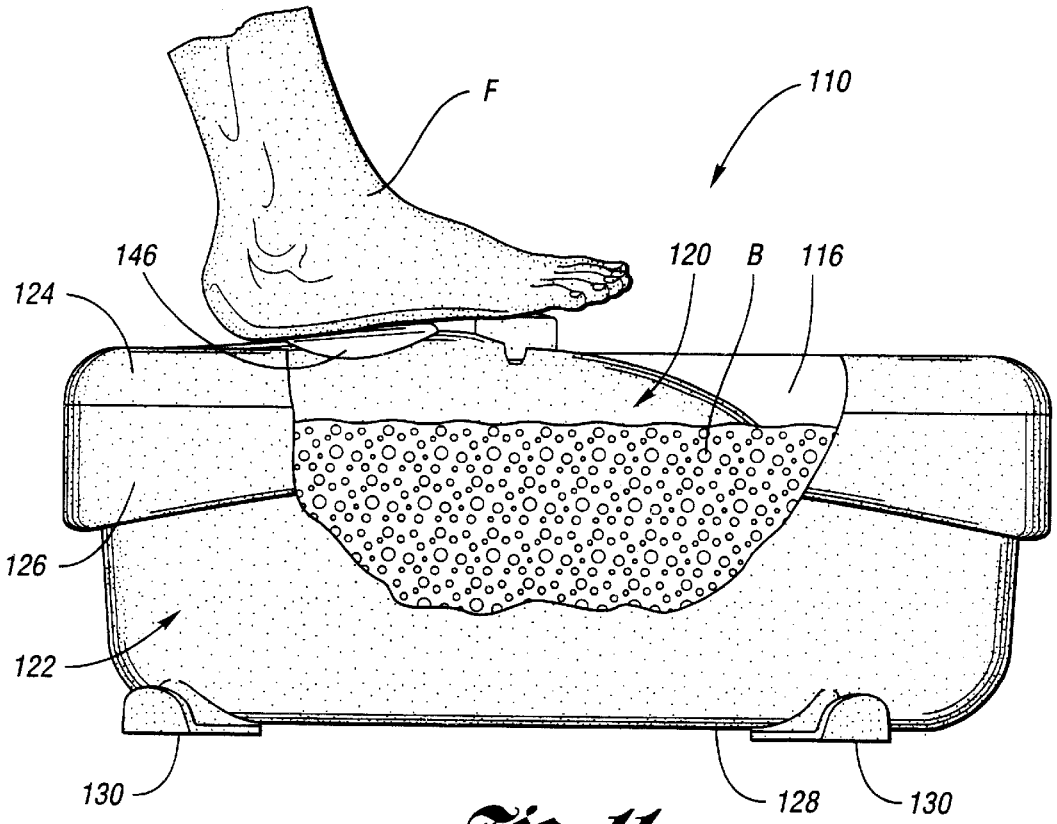
FIG. 11 is a side elevational view of the bath apparatus of FIG. 9, wherein the wall structure is partially cut away to show a user's foot engaging the contact portion.

Referring again to the top plan view of FIG. 2, bottom surface 14 of bath chamber 12 preferably includes a plurality of raised nodes 32 which can be of varying sizes. Nodes 32 function to massage the feet upon contact, and also allow water and heat to flow under the feet to improve blood circulation. As shown in FIGS. 1 and 2, bath apparatus 10 further includes a lid 34 adapted to be attached to wall structure 16 to at least partially cover bath chamber 12. As shown, lid 34 is attached to wall structure 16 by a hinge 36, and includes tabs 38 that are securely received in corresponding openings 40 provided on wall structure 16. Therefore, as shown in FIG. 1, lid 34 can be positioned to partially cover bath chamber 12 to prevent any accidental splashing of water, or lid 34 can be rotated away from bath chamber 12 about hinge 36 for ease of inserting and removing the feet and filling bath chamber 12 with water. Alternatively, as shown in the embodiment of FIGS. 9–10, lid 134 can simply snap fit over wall structure 16 to be completely removable. Lid 34 is preferably constructed from a plastic material, and is sufficiently rigid so that it can be used as a foot rest when only one foot is submersed within bath chamber 12.

Referring again to FIGS. 1–3, a selector 42 is located on upper surface 18 of bath chamber 12, wherein selector 42 is rotatable by a user to selectively provide various combinations of heat, massage, and bubbles to the feet. Wiring interconnects selector 42 with each of the mechanical/electrical assemblies described below which are then powered via connection of a standard power cord 44 to any 110 V AC outlet. In a preferred embodiment, selector 42 can be set to provide three different combinations of bath functions: 1) vibration massage, chamber heat, and targeted infrared heat; 2) vibration massage, bubbles, chamber heat, and targeted infrared heat; and 3) bubbles and chamber heat. However, it is understood that other combinations are fully contemplated in accordance with the present invention.

With reference to FIGS. 1–4, the several mechanical/electrical assemblies of bath apparatus 10 of the present invention will now be described. Each of the following assemblies is housed in the space between bath chamber 12 and outer housing 22 and is selectively powered as determined by the setting of selector 42. First, a heating member 46 is provided on contact portion 20 for providing heat to the foot surface when the foot F is placed on contact portion 20.

Advantageously, heating member 46 provides the capability of focusing heat on the specific region of the foot desired by the user. According to a preferred embodiment of the present invention, heating member 46 uses infrared rays. Infrared rays allow heat to penetrate deep underneath the surface of the skin, causing the pores of the skin to be opened and promoting metabolism and excretion of the body through increased blood circulation. The applied pressure of the foot on heating member 46 can be adjusted by the user for optimum comfort. Although the surface of heating member 46 is shown herein to be generally flat, heating member 46 could have any contour suitable for contact with a user's foot.

In addition to heating member 46, a heater is provided in communication with bath chamber 12. As best shown in FIG. 4, the heater preferably includes a rope heating element 48 secured underneath bottom surface 14 of bath chamber 12. Upon receiving electrical power, as determined by selector 42, rope heating element 48 is operable to conduct heat to the water contained within bath chamber 12. The heated water maintained by rope heating element 48 relieves tired muscles and promotes circulation of the blood. Rope heating element 48 is positioned to wind back and forth to substantially cover bath chamber bottom surface 14. Rope heating element 48 preferably includes insulated conducting wires, wherein the conductive materials are capable of transmitting heat to bath chamber bottom surface 14 without generating temperatures that exceed the melting point of the plastic material used to construct bath apparatus 10.

Bath apparatus 10 further includes a pump 50 in communication with bath chamber 12 for directing air into bath chamber 12 to generate air bubbles in the water contained therein. As shown in FIG. 4, pump 50 forces air through outlet tubes 52 which are connected to bubble egress strips 54 formed in bath chamber bottom surface 14. Air is then forced out of a plurality of egress holes 56 that are provided in bottom surface 14 along each bubble egress strip 54 to form bubbles B in the water contained in bath chamber 12 as illustrated in FIG. 3. Although bubble egress strips 54 are shown herein as being linear in shape, any configuration of bubble egress strips 54 and corresponding egress holes 56 suitable for generating bubbles in bath chamber 12 can be used in accordance with the present invention.

Still further, bath apparatus 10 includes a vibration assembly 58 in communication with bath chamber 12 for imparting vibration to bath chamber 12 to provide a massaging effect to the feet. Vibration assembly 58 includes a motor 60 affixed to an underside of bath chamber 12, an output shaft 62 rotatably driven by motor 60, and a counterweight 64 affixed to output shaft 62. Vibration assembly 58 is affixed underneath a central portion of bath chamber 12 by a motor support bracket 66. When motor 60 is electrically powered, rotation of output shaft 62 and attached counterweight 64 imparts vibrations to motor support bracket 66, and these vibrations are then transferred to bath chamber 12 and the water contained therein in order to massage the feet. It is fully contemplated that variable vibration intensities could be provided in accordance with the present invention.

Turning now to FIGS. 5–8, in further accordance with the present invention, bath apparatus 10 includes one or more interchangeable massage attachments 68, 70, 72 adapted to be received on contact portion 20 for massaging the foot F upon engagement. As with infrared heating member 46, massage attachments 68, 70, 72 advantageously allow for massage to be targeted to specific locations of the foot such as the ball, heel, or arch. In greater specificity, attachments 68, 70, 72 each include a projection 74 sized to be received in a corresponding recess 76 provided in contact portion 20, as illustrated in FIGS. 8*a* and 8*b*. Massage attachments 68 and 70 depicted in FIGS. 5 and 6, respectively, remain stationary once received by contact portion 20, and include different sizes and configurations of raised nodes 78 to provide gently concentrated pressure to a user's foot. Massage attachment 72 includes a roller 80 which is manually rotatable, allowing a user to glide his/her foot back and forth upon roller 80 to release tension. As best shown in FIGS. 1 and 2, a cap 82 is provided to be received in recess 76 when the massage attachments 68, 70, 72 are not in use. Of course, massage attachments 68, 70, 72 are shown only by way of example, and any other suitable massage attachment may be utilized with the present invention.

FIGS. 9–21 illustrate a second embodiment of the bath apparatus according to the present invention, which operates substantially similarly to bath apparatus 10 except for the additional motorized massage and bottom surface features described below. The reference numerals for FIGS. 9–21 correspond generally with the reference numerals for FIGS. 1–8 except for the addition of a "1" prefix.

Figure 12:
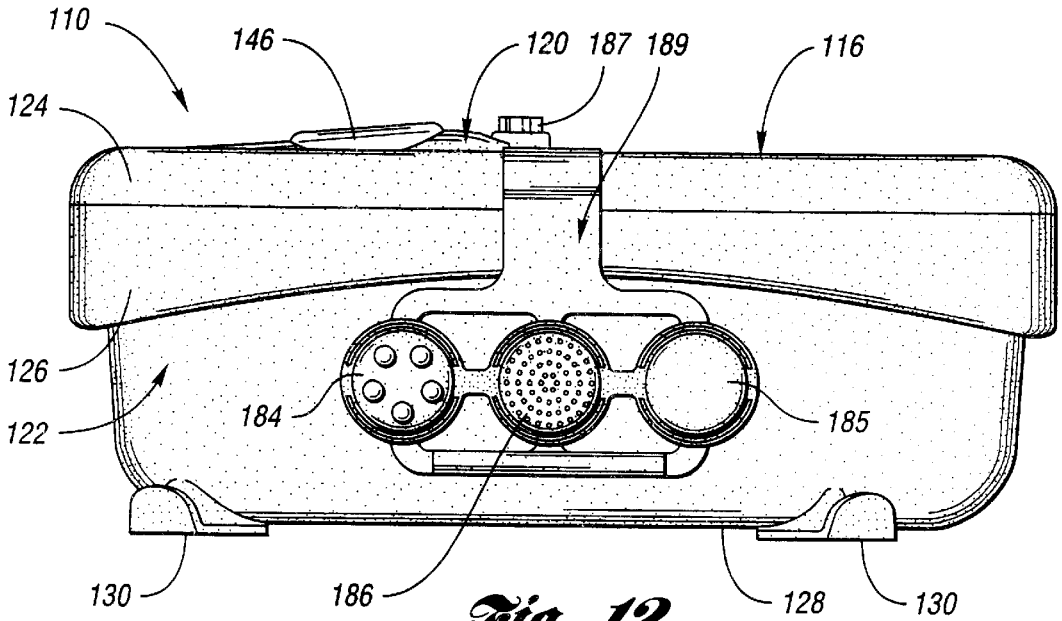
FIG. 12 is a side elevational view of the bath apparatus of FIG. 9 showing a storage unit for the massage attachments hanging from the wall structure.
Figure 13:
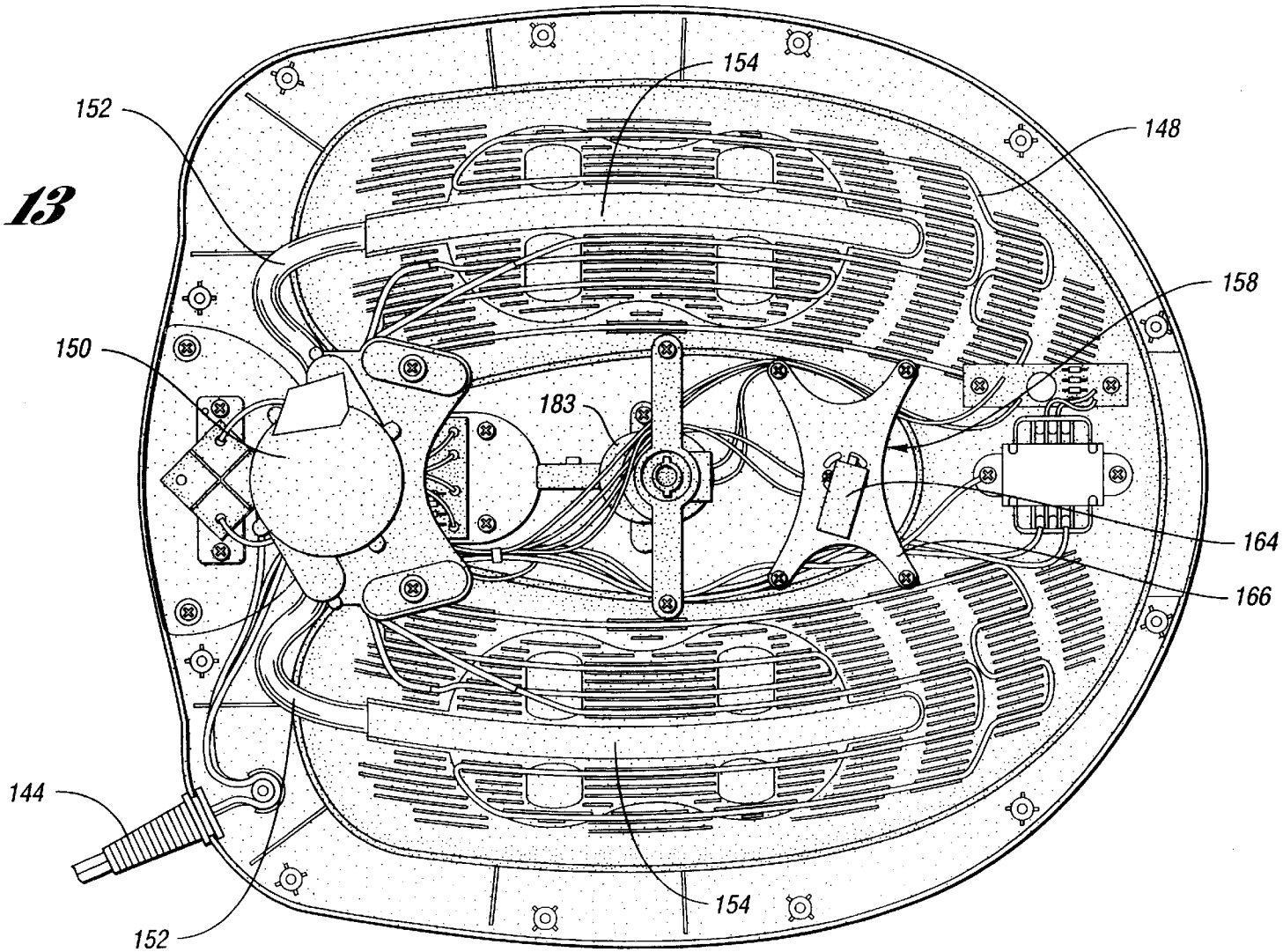
FIG. 13 is a fragmentary view of the pump, heating, vibration, and massage assemblies located on the underside of the bath chamber.

Bath apparatus 110 includes a contact portion 120 for receiving massage attachments 184, 185, 186 (shown in FIGS. 14–18), wherein rotation of massage attachments 184, 185, 186 is motorized. As shown in FIG. 12, a motor 183 is disposed on an underside of bath chamber 112, and massage attachments 184, 185, 186 are adapted to be received on an output shaft 187 that is rotatably driven by motor 183 and adapted to be accessible through contact portion 120. With reference to FIGS. 15 and 18, massage attachments 184, 185, 186 each include a recess 188 configured to securely receive output shaft 187 as it projects through contact portion 120. More particularly, recess 188 includes a plurality of tabs 194 sized to be received in corresponding slots 195 provided on output shaft 187. Therefore, rotation of output shaft 187 causes massage attachments 184, 185, 186 to rotate, even when in contact with a user's foot F. Optionally, the motorized rotation of massage attachments 184, 185, 186 can be activated by pressure of the foot F applied thereon, which then establishes electrical contact to supply power to motor 183. In this case, the operation of motor 183 is preferably not governed by selector 142, but rather power is supplied to motor 183 as long as bath apparatus 110 is plugged in.

Figure 14:
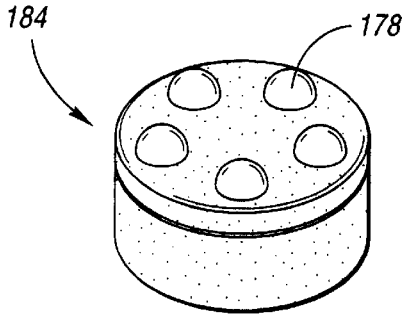
FIG. 14 is a perspective view of a first rotatable massage attachment adapted to be received on the contact portion.
Figure 15:
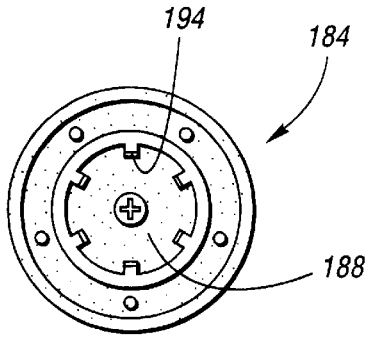
FIG. 15 is a bottom plan view of the first rotatable massage attachment.
Figure 16:
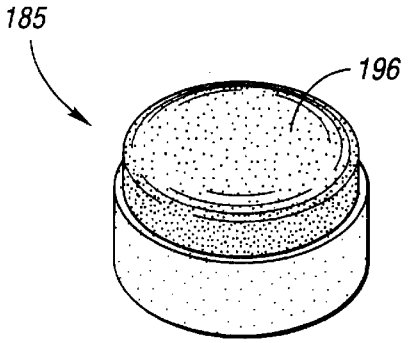
FIG. 16 is a perspective view of a second rotatable massage attachment which includes a pumice stone.
Figure 17:
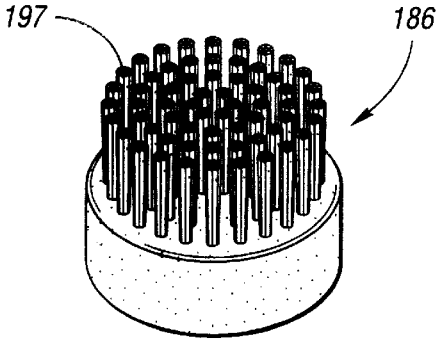
FIG. 17 is a perspective view of a third rotatable massage attachment which includes a brush.
Figure 18A:
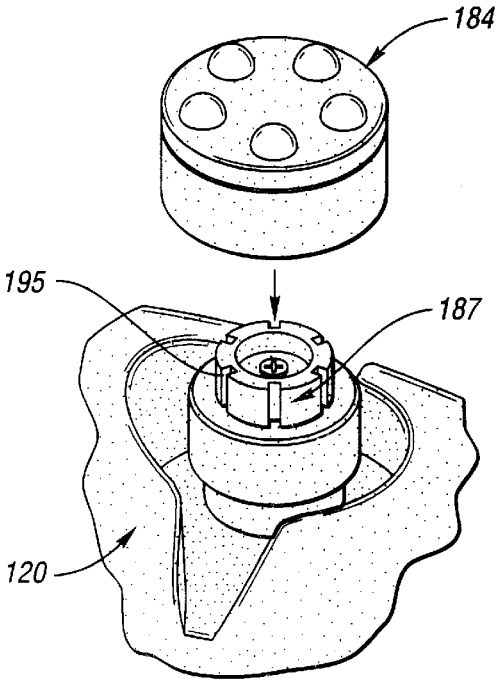
FIGS. 18*a* and 18*b* are fragmentary perspective views of the first rotatable massage attachment before and after attachment to the contact portion, respectively.
Figure 18B:
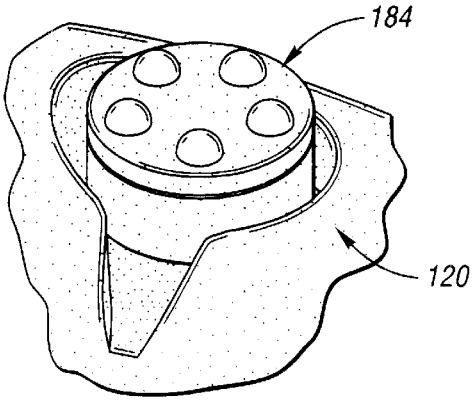
Figure 19:
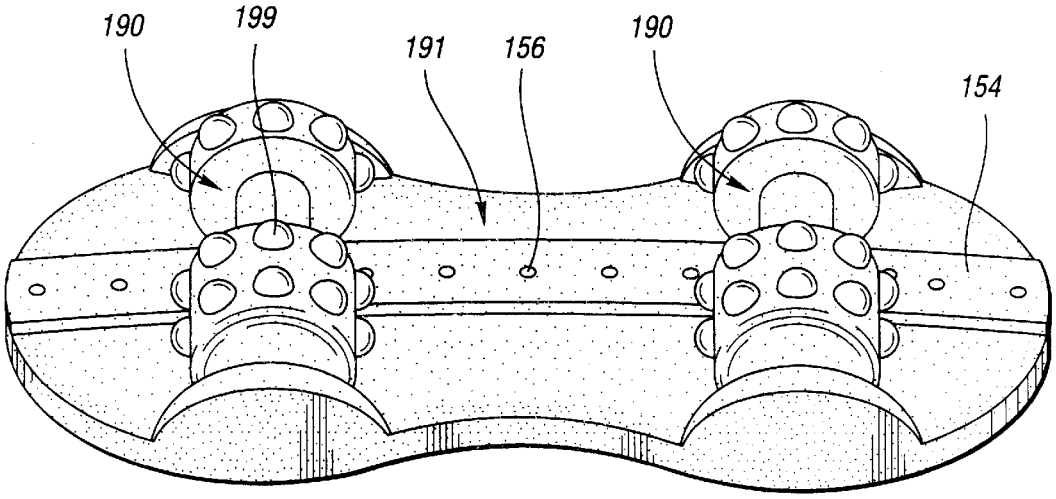
FIG. 19 is a perspective view of a base plate adapted to be received on the bath chamber bottom surface, wherein the base plate includes rollers rotatably affixed thereto.
Figure 20:
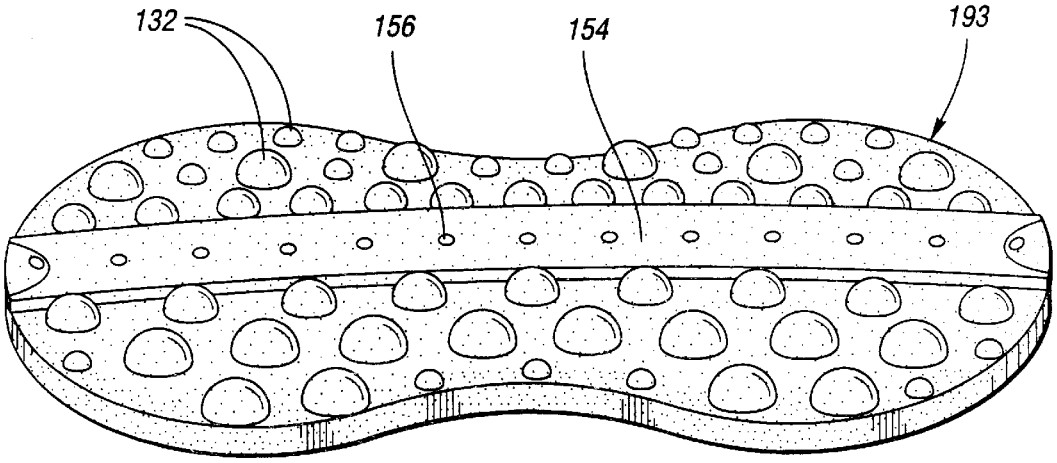
FIG. 20 is a perspective view of a base plate without rollers.
Figure 21A:
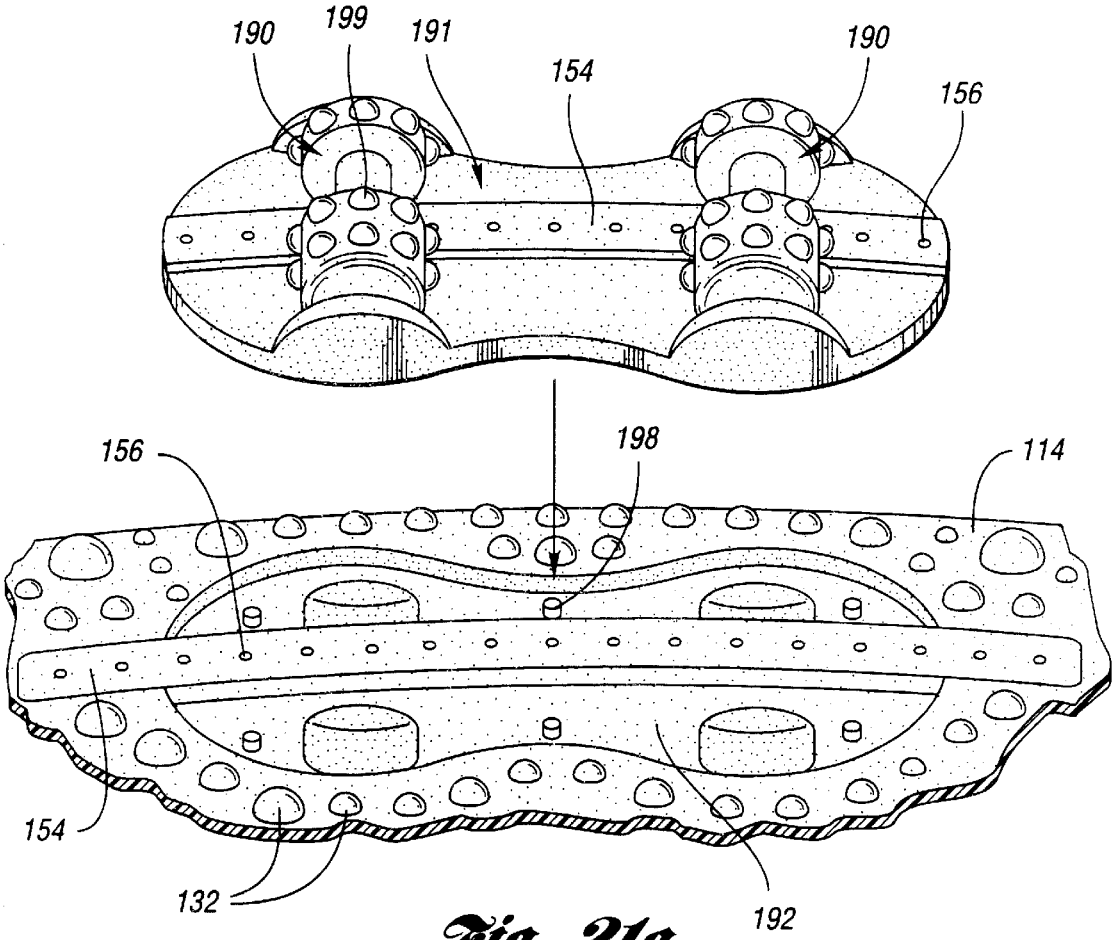
FIGS. 21*a* and 21*b* are fragmentary perspective views of the roller base plate before and after attachment to the bath chamber bottom surface, respectively.
Figure 21B:
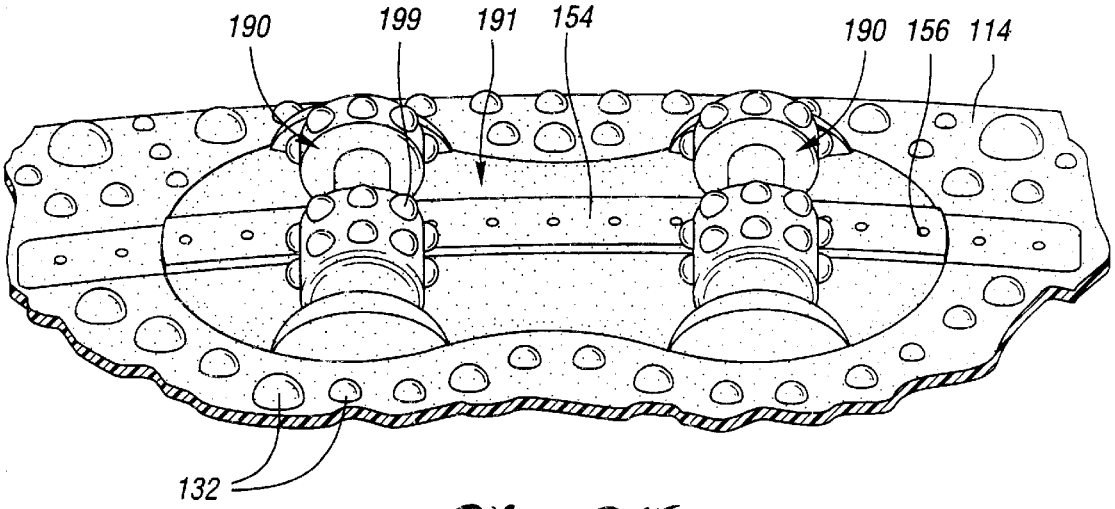

Three different massage attachments for use with bath apparatus 110 are illustrated in FIGS. 14–17. A first rotatable massage attachment 184, as shown in FIG. 14, includes raised nodes 178 which provide pressure points to gently massage a user's foot F when contacted. FIG. 16 depicts a second rotatable massage attachment 185 that includes a pumice stone 196 to smooth and soften skin on the soles of the feet, and FIG. 17 depicts a third rotatable massage attachment 186 that includes a brush 197 to clean and exfoliate skin. As shown in FIG. 12, a storage unit 189 is provided which is adapted to be attached to wall structure 116 for storing the one or more massage attachments 184, 185, 186 therein when not in use. Again, the particular massage attachments 184, 185, 186 shown and described herein are merely exemplary, and any other suitable massage attachment can be used in accordance with the present invention.

Referring now to FIGS. 10 and 19–21, bath apparatus 110 further includes a bottom surface 114 which can include rollers 190 provided thereon. A user can glide his/her foot back and forth across rollers 190 to help relieve tightness and tiredness along soles of feet, as well as for reflexology purposes. Rollers 190 include raised massage nodes 199, and are preferably rotatably attached to a roller plate 191, which is detachable from bottom surface 114, as shown in FIGS. 21*a* and 21*b*. In this embodiment, bottom surface 114 includes indented regions 192 sized to receive roller plates 191 therein, wherein indented regions 192 are of an appropriate depth to allow for roller plates 191 to be generally level with bottom surface 114 when inserted. Furthermore, bottom surface 114 and plates 191, 193 include mating projections 198 and recesses (not shown) for securing plates 191, 193 to bottom surface 114. When a user does not wish to use rollers 190, roller plate 191 can be removed and interchanged with an alternative foot plate 193 which resembles the existing contour of bottom surface 114.

In summary, bath apparatus 10, 110 of the present invention provides the capability to target specific areas of the body with therapeutic heat and massage. Therefore, bath apparatus 10, 110 allows users to tailor therapy regimens to their individual needs, and also increases the efficiency of therapy sessions due to the concentration of heat and massage at desired locations.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for bathing a body part, the apparatus comprising:

a bath chamber for containing a fluid and receiving the body part therein, the bath chamber including a bottom surface and a wall structure extending upwardly therefrom, the wall structure having a contact area; and a heating member provided on the contact area, the heating member arranged fluid contained in the bath chamber for providing heat to the body part is placed on the contact area.

2. The apparatus according to claim 1, wherein the heating member uses infrared rays.

3. The apparatus according to claim 1, further including a heater in communication with the bath chamber for maintaining the heat of the fluid contained therein.

4. The apparatus according to claim 3, wherein the heater includes a rope heating element provided underneath the bottom surface of the bath chamber.

5. The apparatus according to claim 1, further including an air pump in communication with the bath chamber for directing air into the bath chamber to generate air bubbles in the fluid contained within the bath chamber.

6. The apparatus according to claim 5, wherein the air pump directs air through a plurality of holes provided in the bottom surface of the bath chamber.

7. The apparatus according to claim 1, further including a vibration assembly in communication with the bath chamber for imparting vibration to the bath chamber.

8. The apparatus according to claim 7, wherein the vibration assembly includes a motor affixed to an underside of the bath chamber, an output shaft rotatably driven by the motor, and a counterweight affixed to the output shaft.

9. The apparatus according to claim 1, further including at least one massage attachment adapted to be received on the contact area for massaging the body part when the body part engages the massage attachment.

10. The apparatus according to claim 9, wherein the at least one massage attachment is stationary.

11. The apparatus according to claim 9, wherein the at least one massage attachment is manually rotatable.

12. The apparatus according to claim 9, wherein the at least one massage attachment includes raised nodes.

13. The apparatus according to claim 9, wherein the at least one massage attachment includes a roller.

14. The apparatus according to claim 1, further including a plurality of raised nodes provided on the bottom surface of the bath chamber.

15. The apparatus according to claim 1, further including a lid adapted to be attached to the wall structure to at least partially cover the bath chamber.

16. The apparatus according to claim 1, wherein the bath chamber is generally U-shaped and the contact area is generally peninsular within the bath chamber.

17. The apparatus according to claim 1, further comprising an outer housing which encases the bath chamber.

18. A foot bath, comprising:

a generally U-shaped bath chamber for containing water and receiving at least one foot therein, the bath chamber including a bottom surface and a wall structure extending upwardly therefrom, the wall structure terminating in an upper surface that includes a peninsular contact portion; and a heating member provided on the contact portion, the heating member arranged to be uncovered by water contained in the bath chamber and using infrared rays for providing heat to a surface of the foot when the foot surface is placed on the contact portion.

19. The foot bath according to claim 18, further including a heater provided underneath the bottom surface of the bath chamber for maintaining the heat of the water contained within the bath chamber.

20. The foot bath according to claim 18, further including an air pump in communication with the bath chamber for directing air through a plurality of holes provided in the bottom surface of the bath chamber to generate air bubbles in the water contained within the bath chamber.

21. The foot bath according to claim 18, further including a vibration assembly in communication with the bath chamber for imparting vibration to the bath chamber.

22. The foot bath according to claim 18, further including at least one massage attachment adapted to be received on the contact portion for massaging the foot surface when the foot surface engages the massage attachment.

23. The foot bath according to claim 18, wherein the peninsular contact portion is centrally disposed within the bath chamber.

* * * * *

UNITED STATES PATENT AND TRADEMARK OFFICE

CERTIFICATE OF CORRECTION

PATENT NO. : 6,385,795 B1
DATED : May 14, 2002
INVENTOR(S) : Roman S. Ferber and Alex Wong Chi To It is certified that error appears in the above-identified patent and that said Letters Patent is hereby corrected as shown below:

Column 7,
Line 36, after "arranged" insert -- to be uncovered by --.
Line 37, after "part" insert -- when the body part --.

Signed and Sealed this

Tenth Day of September, 2002

*Attest:*

*Attesting Officer*

JAMES E. ROGAN
*Director of the United States Patent and Trademark Office*